United States Patent [19]

Bucci

[11] Patent Number: 5,006,452

[45] Date of Patent: Apr. 9, 1991

[54] SILVER HALIDE COLOR PHOTOGRAPHIC LIGHT-SENSITIVE MATERIAL

[75] Inventor: Marco Bucci, Genova/Nervi, Italy

[73] Assignee: Minnesota Mining and Manufacturing Company, St. Paul, Minn.

[21] Appl. No.: 278,471

[22] Filed: Dec. 1, 1988

[30] Foreign Application Priority Data

Dec. 17, 1987 [IT] Italy ..... 23055 A/87

[51] Int. Cl.[5] ..... G03C 1/08

[52] U.S. Cl. ..... 430/544; 430/557; 430/957

[58] Field of Search ..... 430/544, 557, 957

[56] References Cited

U.S. PATENT DOCUMENTS

| | | | |
|---|---|---|---|
| 3,617,291 | 11/1971 | Sawdey | 430/544 |
| 4,145,219 | 3/1979 | Kato et al. | 96/74 |
| 4,256,881 | 3/1981 | Simons et al. | 430/544 |
| 4,477,563 | 10/1984 | Ichijima et al. | 430/544 |

FOREIGN PATENT DOCUMENTS

| | | |
|---|---|---|
| 0101621 | 2/1984 | European Pat. Off. . |
| 0115302 | 8/1984 | European Pat. Off. . |
| 2010818 | 7/1979 | United Kingdom . |

*Primary Examiner*—Charles L. Bowers, Jr.
*Assistant Examiner*—Thomas R. Neville
*Attorney, Agent, or Firm*—Gary L. Griswold; Walter N. Kirn; Mark A. Litman

[57] ABSTRACT

Silver halide color photographic ligt-sensitive material which comprises a support having thereon at least one silver halide emulsion layer containing a diketomethylene yellow dye forming coupler having bonded, directly or through a connecting group, to the coupling active position a group which provides a compound having a development inhibiting property when the group is released from the coupler active position upon the color development reaction, wherein said group is a 4,7-dihalogen-2-benzotriazolyl group.

8 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a photographic coupler and, more particularly, a DIR (Development Inhibitor Releasing) coupler capable of releasing a development inhibiting compound upon reaction with the oxidation product of a developing agent.

BACKGROUND OF THE ART

It is well known that color photographic light-sensitive materials, using the subtractive process for color reproduction, comprise silver halide emulsion layers selectively sensitive to blue, green and red light and associated with yellow, magenta and cyan dye forming couplers which form (upon reaction with an oxidized primary amine type color developing agent) the complementary color thereof. For example, an acylacetanilide type coupler is used to form a yellow color image; a pyrazolone, pyrazolotriazole, cyanacetophenone or indazolone type coupler is used to form a magenta color image; and a phenol type, such as a phenol or naphthol, coupler is used to form a cyan color image.

Usually, the color photographic light-sensitive materials comprise non-diffusible couplers incorporated independently in each of the light-sensitive layers of the material (incorporated coupler materials). Therefore, a color photographic light-sensitive material usually comprises a blue-sensitive silver halide emulsion layer (or layers) which contains a yellow coupler and which is mainly sensitive to blue light (substantially to wavelenghts less than about 500 nm), a green-sensitive silver halide emulsion layer (or layers) which contains a magenta coupler and which is mainly sensitive to green light (substantially to wavelengths of about 500 to 600 nm) and a red-sensitive silver halide emulsion layer (or layers) which contains a cyan coupler and which is mainly sensitive to red light (substantially to wavelengths longer than about 590 nm).

It is also known to incorporate into a light-sensitive color photographic material a compound capable of releasing a development inhibitor during development upon reaction with the oxidation product of a color developing agent. Typical examples of said compounds are the DIR (Development Inhibitor Releasing) couplers having a group having a development inhibiting property when released from the coupler introduced at the coupling position of the coupler. Examples of DIR couplers are described by C. R. Barr, J. R. Thirtle and P. W. Wittum, Photographic Science and Eng., vol. 13. pp 74–80 (1969) and ibid. pp 214–217 (1969) or in U.S. Pat. Nos. 3,227,554, 3,615,506, 3,617,291, 3,701,783, 3,933,500 and 4,149,886.

The purpose of DIR couplers is to reduce grainines and improve sharpness of the image due to intralayer or intraimage effects (that is in the same layers or the same dye image) and improve color reproduction due to interlayer or interimage effects (that is in different layers or different dye images). Usually, however, the DIR coupler causes, in the light-sensitive silver halide multilayer color element in which is used, interimage effects mainly in the high-density areas of the negative image, while it is often desirable to obtain interimage effects in the low-density areas which much more affects image characteristics such as color saturation and brilliance.

Therefore, in order to more effectively use the DIR couplers, it is desirable to develop novel DIR couplers which improve interimage effects of lightsensitive silver halide multilayer color elements.

Several substituents on the phenyl ring of the 2-benzotriazolyl development inhibiting group of DIR couplers have been described, for example in U.S. Pat. Nos. 3,617,291, 4,145,219 and 4,477,563, in GB Pat. Appln. 2,010,818, in EP Pat. Appln. 115,302 and 101,621. However, there is nothing in the cited references which would suggest that appropriate selection and combination of substituents on the phenyl ring of a 2-benzotriazolyl development inhibitor group would give the aforementioned desired improvements in interimage effects.

SUMMARY OF THE INVENTION

The present invention relates to a silver halide color photographic light-sensitive material which comprises a support having thereon at least one silver halide emulsion layer containing a diketomethylene yellow dye forming coupler having bonded, directly or through a connecting group, to the coupling active position a group which provides a compound having a development inhibiting property when the group is released from the coupler active position upon the color development reaction, wherein said group is a 4,7-dihalogen-2-benzotriazolyl group.

Said silver halide color light-sensitive material containing the novel yellow dye forming DIR coupler provides, upon exposure and development, color images of improved image quality.

DETAILED DESCRIPTION OF THE INVENTION

The photographic DIR couplers according to the present invention are characterized by having a 4,7-dihalogen-2-benzotriazolyl group bonded, directly or through a connecting group, to the active methylene group (coupling active position) of a yellow dye forming coupler through the 2-nitrogen atom of said group, the remaining 5 and 6 positions of said group being substituted or unsubstituted.

The DIR couplers according to the present invention comprise materials having the common nucleus of formula (I):

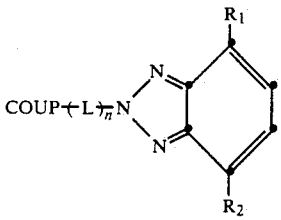

(I)

wherein COUP represents a yellow dye forming coupler residue (with an available bond at the reactive position) which is bonded, directly or through a connecting group, to the 2-nitrogen atom, $R_1$ and $R_2$ may be the same or different and each represents a halogen atom (chlorine, bromine, iodine and fluorine), L represents a connecting group and n represents 0 or 1.

In particular, the DIR couplers according to the present invention can be represented by the formula (II):

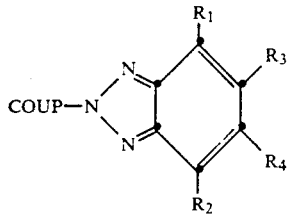

(II)

wherein COUP represents a yellow dye forming coupler residue; $R_1$ and $R_2$, the same or different, each represents a halogen atom (chlorine, bromine, iodine and fluorine); $R_3$ and $R_4$, the same or different, each represents a hydrogen atom, a halogen atom (chlorine, bromine, iodine and fluorine), an amino group, an alkyl group having 1 to 4 carbon atoms (methyl, ethyl, buthyl, chloromethyl, trifluoromethyl, 2-hydroxyethyl, etc.), an alkoxy group having 1 to 4 carbon atoms (methoxy, chloromethoxy, ethoxy, buthoxy, etc.), a hydroxy group, a cyano group, an aryloxy group (phenoxy, p-methoxyphenoxy, etc.), an acyloxy group (acyloxy, benzoyloxy, etc.), an acyl group (acyl, benzoyl, etc.), an alkoxycarbonyl group (methoxycarbonyl, butyloxycarbonyl, etc.), an aryloxycarbonyl group (benzoxycarbonyl, etc.), an acylamino group (acetamido, benzamido, etc.), an alkylsulphonyl group (methylsulfonyl, chloromethylsulfonyl, etc.), an arylsulphonyl group (phenylsulfonyl, naphthylsulfonyl, etc.), an alkoxysulphonyl group (ethoxysulfonyl, butoxysulfonyl, etc.), an aryloxysulphonyl group (phenoxysulfonyl, 2-methoxyphenoxysulfonyl, etc.) or an ureido group (phenylureido, butaneureido, etc). When the term "group" is used to describe a chemical compound or substituent, the described chemical material includes the basic group and that group with conventional substitution. Where the term "moiety" is used to describe a chemical compound or substituent only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, octyl, stearyl, cyanohexyl, etc.

The 4,7-dihalogen-2-benzotriazolyl group attached to the coupling active position of a diketomethylene yellow dye forming coupler proved to give unique results in terms of image quality.

With the reference to the diketomethylene yellow dye forming coupler residue represented by COUP above, any residue of diketomethylene yellow dye forming coupler known in the art may be used. By the term "residue" is meant the substantive portion of the coupler, exclusive of a splitting-off or leaving group attached at the coupling active position. Examples of diketomethylene yellow dye forming couplers include pivaloylacetanilide type couplers, benzoylacetanilide type couplers, malondiester type couplers, malondiamide type couplers, dibenzoylmethane type couplers, malonester monoamide type couplers, benzothiazolylacetate type couplers, benzoxazolylacetamide type couplers, benzoxazolylacetate type couplers, benzimidazolylacetamice type couplers or benzimidazolylacetate type couplers, hetero ring substituted acetamide or hetero ring substituted acetate type couplers as described in U.S. Pat. No. 3,841,880, acylacetamide type couplers as described in U.S. Pat. No. 3,770,446, GB Pat. No. 1,459,171, DE Pat. Appln. No. 2,503,099, JA Pat. Appln. No. 139738/75 and Research Disclosure No. 15737, a heterocyclic type coupler as described in U.S. Pat. No. 4,046,574 or the like.

Preferred examples of yellow dye forming DIR couplers according to the present invention are represented by the general formula (III)

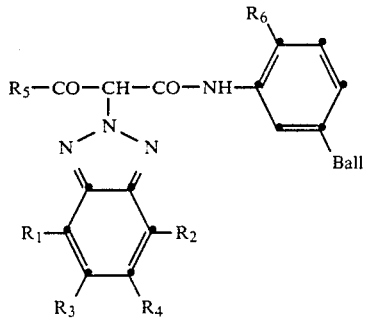

(III)

wherein $R_1$ and $R_2$ each represents a halogen atom, $R_3$ and $R_4$ each represents a hydrogen atom, a halogen atom or a substituent as defined for formula (II) above, $R_5$ represents an alkyl group or an aryl group, $R_6$ represents an halogen atom, an alkoxy group or an alkyl group and Ball is an hydrophobic ballasting group.

In the formula (III) above, the alkyl group represented by $R_5$ has preferably from 3 to 8 carbon atoms and more preferably is a branched chain alkyl group (such as, for example, an isopropyl group, a tert-butyl group or a tert-amyl group), and the aryl group represented by $R_5$ is preferably a phenyl group optionally substituted by alkyl or alkoxy groups having 1 to 5 carbon atoms (for example, a 2- or 4-alkyl-phenyl group such as a 2-methylphenyl group, or a 2- or 4-alkoxyphenyl group such as a 2-methoxyphenyl group, a 4-isopropoxyphenyl group or a 2-butoxyphenyl group). $R_6$ represents an halogen atom (such as chlorine) or an alkyl or alkoxy group having 1 to 4 carbon atoms (such as methyl, ethyl, propyl, isoproyl, n-butyl, tert-butyl, methoxy, ethoxy, propoxy, isopropoxy, n-butoxy and tert-butoxy groups).

The ballasting group (Ball) of the formula (III) above acts as a "ballast" which can maintain the DIR coupler in a specific layer so as to substantially prevent said coupler from diffusing to any other layer in a multilayer color photographic element. The group has a sufficient bulkiness to complete that purpose. Usually a group having a hydrophobic group of 8 to 32 carbon atoms is introduced in the coupler molecule as ballasting group. Such group can be bonded to the coupler molecule directly or through an amino, ether, carbonamido, sulfonamido, ureido, ester, imido, carbamoyl, sulfamoyl, phenylene, etc., bond. Specific examples of ballasting groups are illustrated in U.S. Pat. No. 4,009,083, in European Pat. Nos. 87,930, 84,100, 87,931, 73,146, and 88,563, in German Pat. Nos. 3,300,412 and 3,315,012, in Japanese Pat. Nos. 58/33248, 58/33250, 58/31334, 58/106539. Preferably, such ballasting groups comprise alkyl chains, the total carbon atoms of which are no more than 20.

Still preferred examples of yellow dye forming DIR couplers are represented by the general formula (IV) or (V):

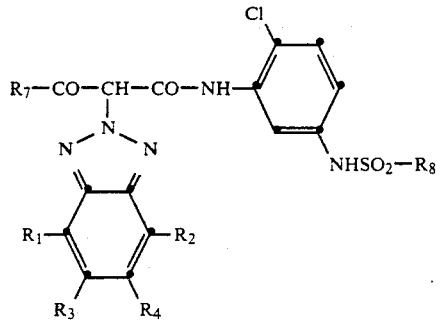

(IV)

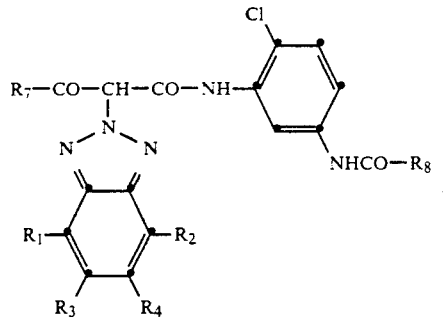

(V)

wherein $R_1$ and $R_2$ each represents a halogen atom, $R_3$ and $R_4$ each represents a hydrogen atom, a halogen atom or a substituent as defined for formula (II) above, $R_7$ represents a branched chain alkyl group, preferably a branched chain alkyl group having 3 to 8 carbon atoms (such as, for example, a isopropyl group, an isobutyl group, a tert-butyl group or a tert-amyl group), $R_8$ represents an alkyl group, preferably an alkyl group having 8 to 22 carbon atoms (such as, for example, a dodecyl group, a tetradecyl group, a hexadecyl group or an octadecyl group), a phenoxyalkyl group, preferably a phenoxyalkyl group having 10 to 32 carbon atoms (such as, for example, a gamma-(2,4-ditert-amylphenoxy)propyl group), an alkoxyphenyl group, preferably an alkoxyphenyl group having 10 to 32 carbon atoms, or an aralkyl group, preferably an aralkyl group having 10 to 32 carbon atoms.

More preferred examples of diketomethylene yellow dye forming DIR couplers according to the present invention are represented by the general formula (VI)

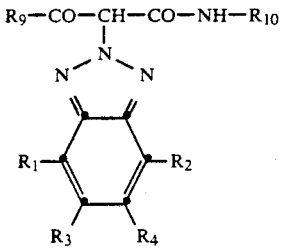

(VI)

wherein $R_1$ and $R_2$ each represents a halogen atom, $R_3$ and $R_4$ each represents a hydrogen atom, a halogen atom or a substituent as defined for formula (II) above, $R_9$ represents an alkyl group, an aryl group or a $-NR_{11}R_{12}$ group wherein $R_{11}$ represents a hydrogen atom or an alkyl group and $R_{12}$ represents an alkyl group or an aryl group, and $R_{10}$ represents an alkyl group or an aryl group.

In the formula (VI) above, the alkyl group represented by $R_9$, $R_{10}$ and $R_{12}$ has preferably from 1 to 18 carbon atoms and may be substituted or unsubstituted. Preferred examples of substituents of the alkyl group include an alkoxy group, an aryloxy group, a cyano, an amino group, an acylamino group, a halogen atom, an hydroxy group, a carboxy group, a sulfo group, an heterocyclic group, etc. Practical examples of useful alkyl groups are an isopropyl group, an isobutyl group, a tertbutyl group, an isoamyl group, a tert-amyl group, a 1,1-dimethylbutyl group, a 1,1-dimethylhexyl group, a 1,1-diethylhexyl group, a 1,1-dimethyl-1-methoxyphenoxymethyl group, a 1,1-di-methyl-1-ethylthiomethyl group, a dodecyl group, a hexadecyl group, an octadecyl group, a cyclohexyl group, a 2-methoxyisopropyl group, a 2-phenoxyisopropyl group, an alpha-aminoisopropyl group, an alpha-succinimidoisopropyl group, etc.

The aryl group represented by $R_9$, $R_{10}$ and $R_{12}$ has preferably from 6 to 35 total carbon atoms and includes in particular a substituted phenyl group and an unsubstituted phenyl group. Preferred examples of substituents of the aryl group include a halogen atom, a nitro group, a cyano group, a thiocyano group, a hydroxy group, an alkoxy group (preferably having 1 to 15 carbon atoms, such as methoxy, isopropoxy, octyloxy, etc.), an aryloxy group (such as phenoxy, nitrophenoxy, etc.), an alkyl group (preferably having 1 to 15 carbon atoms, such as methyl, ethyl, dodecyl, etc.), an alkenyl group (preferably having 1 to 15 carbon atoms, such as allyl), an aryl group (preferably having 6 to 10 carbon atoms, such as phenyl, tolyl, etc.), an amino group (e.g. an unsubstituted amino group or an alkylamino group having 1 to 15 carbon atoms such as diethylamino, octylamino, etc.), a carboxy group, an acyl group (preferably having 2 to 16 carbon atoms such as acetyl, decanoyl, etc.), an alkoxycarbonyl group (preferably having the alkyl moiety of 1 to 20 carbon atoms, such as methoxycarbonyl, butoxycarbonyl, octyloxycarbonyl, dodecyloxycarbonyl, 2-methoxyethoxycarbonyl, etc.), an aryloxycarbonyl group (preferably having the aryl moiety of 6 to 20 carbon atoms, such as phenoxycarbonyl, tolyloxycarbonyl, tolyoxycarbonyl, etc.), a carbamoyl group (such as ethylcarbamoyl, octylcarbamoyl, etc.), an acylamino group (preferably having 2 to 21 carbon atoms, such as acetamido, octanamido, 2,4-di-tert-pentylphenoxyacetamido, etc.), a sulfo group, an alkylsulfonyl group (preferably having 1 to 15 carbon atoms, such as methylsulfonyl, octylsulfonyl, etc.), an arylsulfonyl (preferably having 6 to 20 carbon atoms, such as phenylsulfonyl, octyloxyphenylsulfonyl, etc.), an alkoxysulfonyl (preferably having 1 to 15 carbon atoms, such as methoxysulfonyl, octyloxysulfonyl, etc.), an aryloxysulfonyl (preferably having 6 to 20 carbon atoms, such as phenoxysulfonyl, etc.), a sulfamoyl group (preferably having 1 to 15 carbon atoms, such as diethylsulfamoyl, octylsulfamoyl, methyloctadecylsulfamoyl, etc.), a sulfonamino group (preferably having 1 to 15 carbon atoms, such as methylsulfonamino, octylsulfonamino, etc.) and the like.

The alkyl group represented by $R_{11}$ in the formula (VI) above is preferably a lower alkyl group having 1 to 4 carbon atoms, such as a methyl group, an ethyl group, a n-propyl group, a iso-propyl group, a n-butyl group, a iso-butyl group or a tert-butyl group.

The total number of carbon atoms of $R_9$, $R_{10}$, $R_{11}$ and $R_{12}$ in the formula (VI) above is preferably less than 60, more preferably less than 50.

In another aspect of the present invention the 4,7-dihalogen-2-benzotriazolyl group is attached to the active methylene group (coupling active position) of a diketomethylene yellow dye forming coupler through connecting group L. In particular, said connecting group L is a timing group joining the coupler and the 4,7-dihalogen-2-benzotriazolyl group, said timing group being displaced from said coupler on reaction with an oxidized color developing agent and the resulting timing and 4,7-dihalogen-2-benzotriazolyl group being able to undergo a reaction (such as an intramolecular nucleophilic displacement reaction as described in U.S. Pat. No. 4,248,962 or an electron transfer reaction along a conjugated system as described in U.S. Pat. No. 4,409,323) to release the 4,7-dihalogen-2-benzotriazolyl group.

Preferred examples of yellow dye forming DIR couplers according to said aspect of the present invention are represented by the general formula (VII)

(VII)

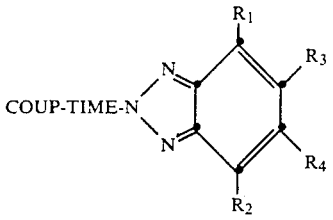

wherein COUP represents a yellow dye forming coupler residue, TIME is a timing group joining the coupler residue to the 4,7-dihalogen-2-benzotriazolyl group, $R_1$ and $R_2$ each represents a halogen atom and $R_3$ and $R_4$ each represent a hydrogen atom, a halogen atom or a substituent as defined for formula (II) above.

Examples of timing groups represented by TIME in formula (VII) include, for example, the following groups:

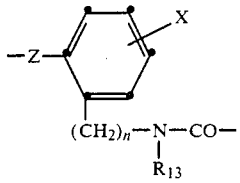

wherein Z is oxygen or sulfur and is attached to coupler moiety COUP, n is 0 or 1, $R_{13}$ is hydrogen or an alkyl of 1 to 4 carbon atoms or an aryl of 6 to 10 carbon atoms, X is hydrogen, halogen, cyano, nitro, alkyl of 1 to 20 carbon atoms, alkoxy, alkoxycarbonyl, acylamino, aminocarbonyl, etc., as described in U.S. Pat. No. 4,248,962,

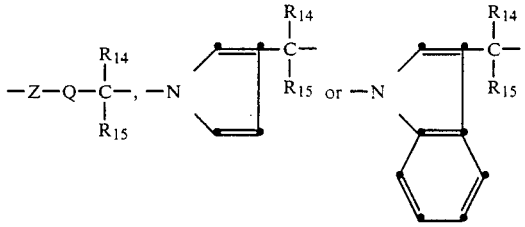

wherein the left hand side is attached to coupler moiety COUP, Z is oxygen or sulfur or

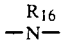

$R_{14}$, $R_{15}$ and $R_{16}$ are individually hydrogen, alkyl or aryl groups, and Q is a 1,2- or 1,4-phenylene or naphthylene group, as described in U.S. Pat. No. 4,409,323.

Specific examples of yellow dye forming DIR couplers of the present invention are given below as illustrative examples.

(Coupler 1)

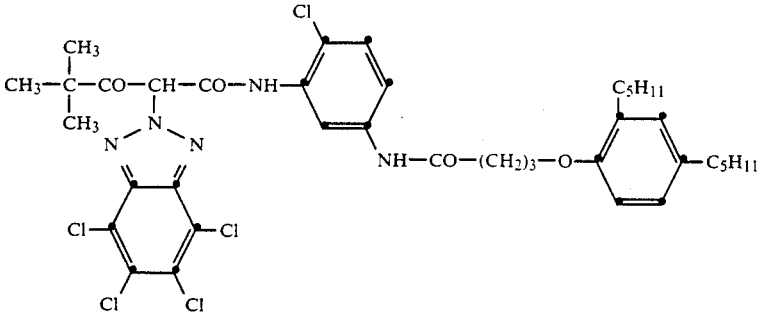

-continued
(Coupler 2)
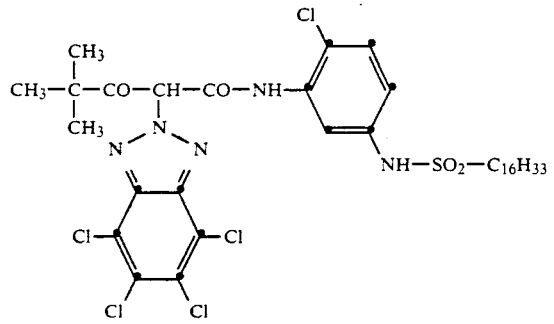
(Coupler 3)
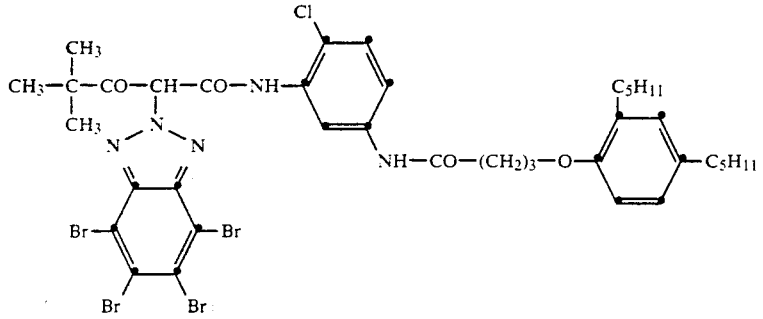
(Coupler 4)
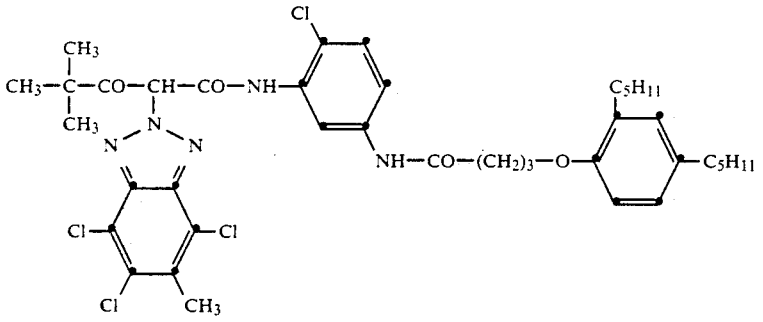
(Coupler 5)
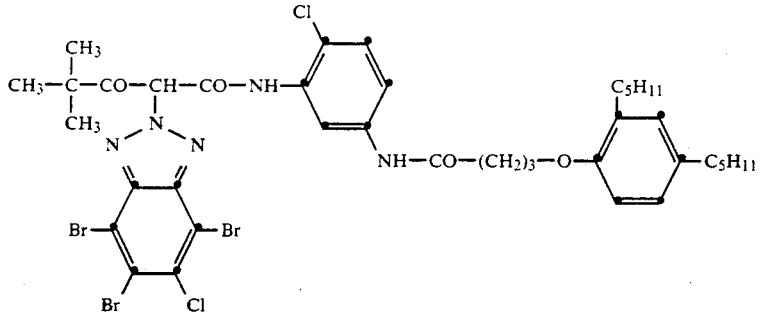
(Coupler 6)
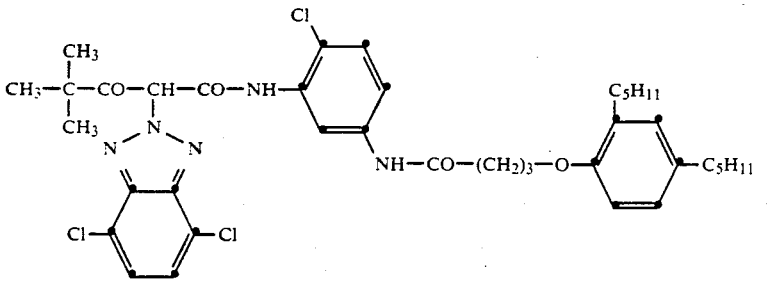

-continued
(Coupler 7)
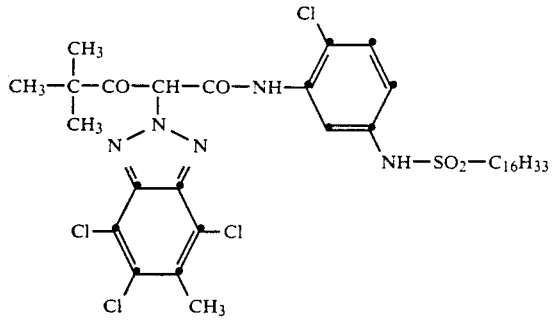
(Coupler 8)
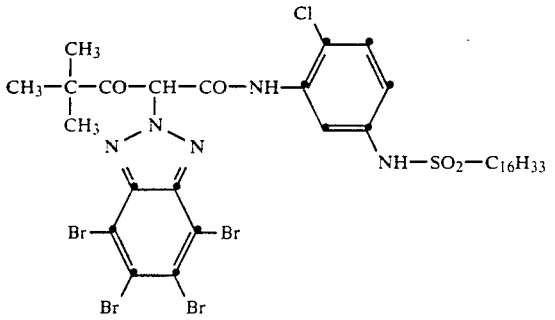
(Coupler 9)
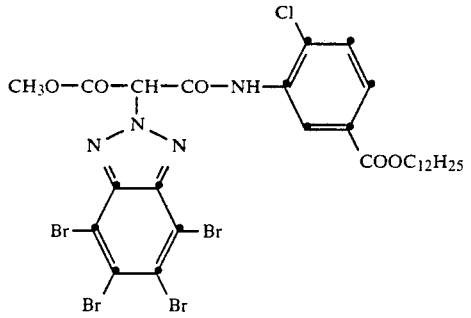
(Coupler 10)
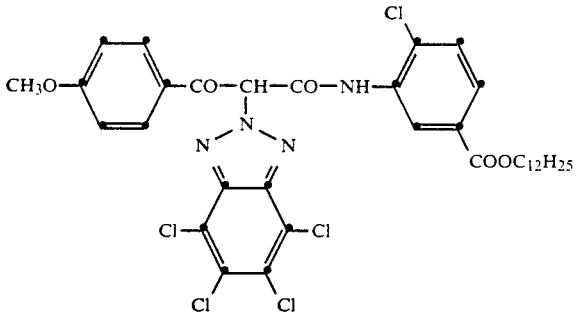
(Coupler 11)
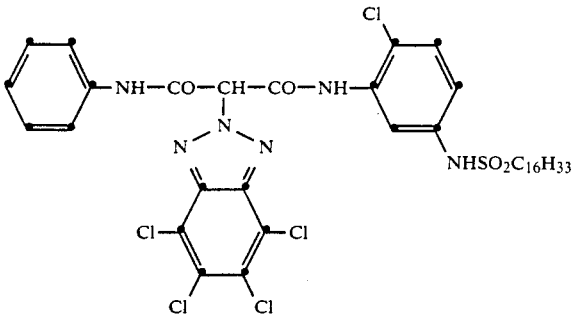

-continued
(Coupler 12)
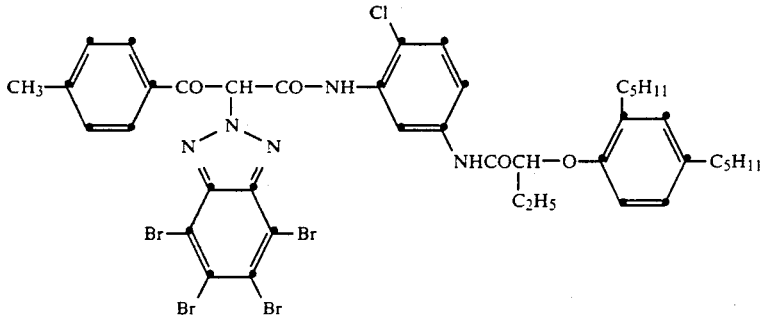
(Coupler 13)
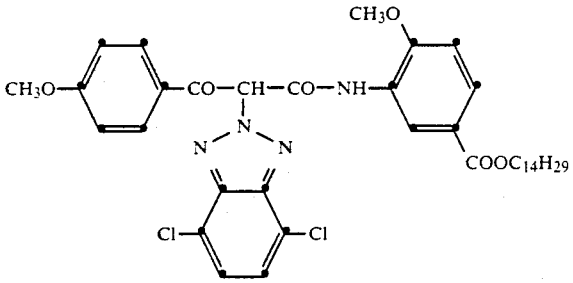
(Coupler 14)
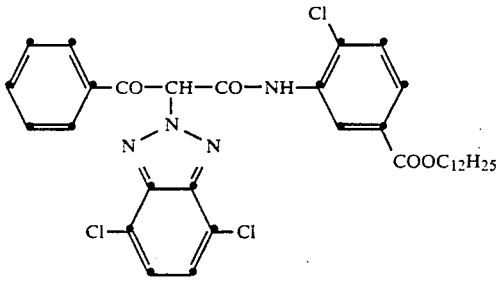
(Coupler 15)
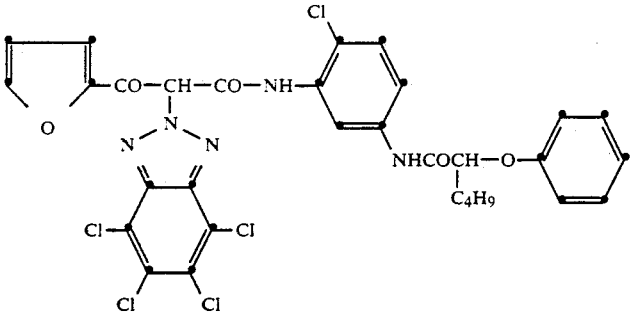
(Coupler 16)
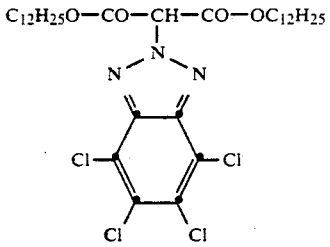

-continued
(Coupler 17)
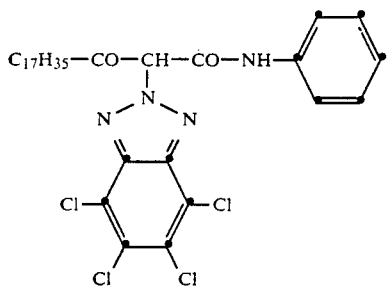
(Coupler 18)
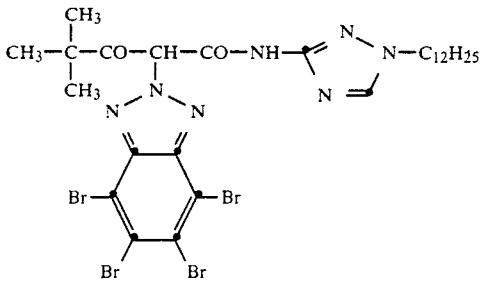
(Coupler 19)
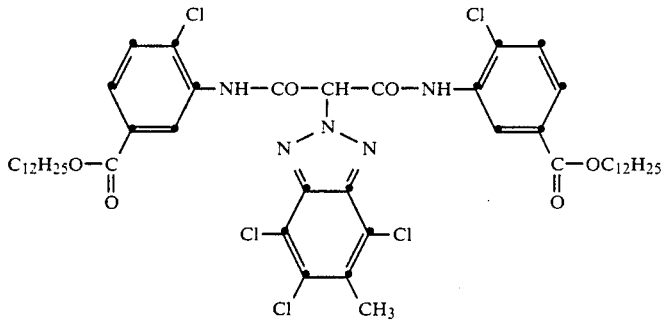
(Coupler 20)
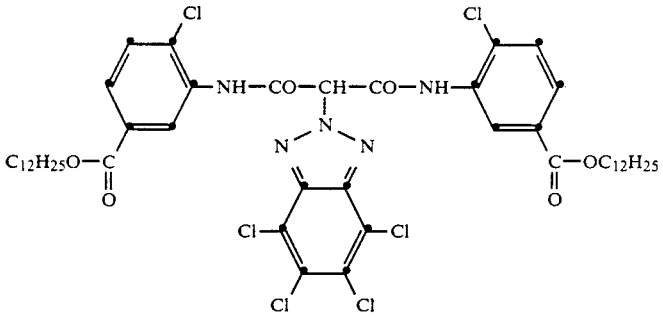
(Coupler 21)
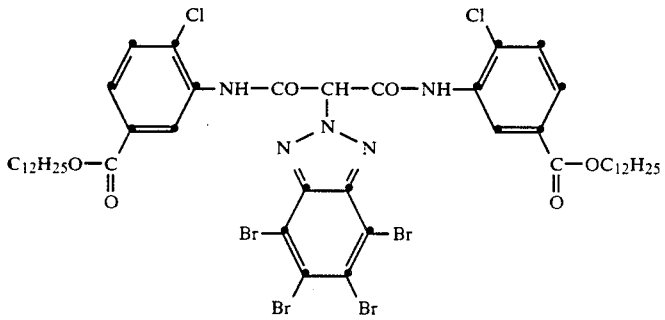

-continued
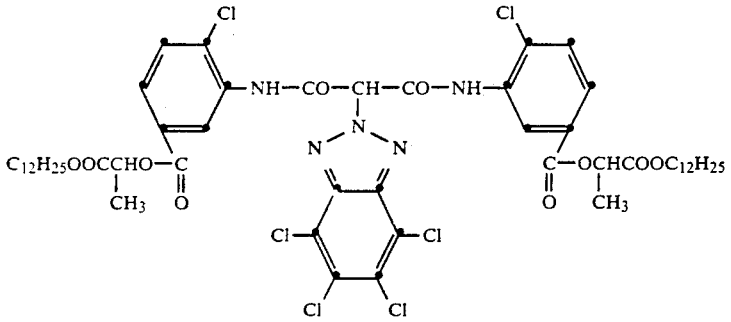
(Coupler 22)
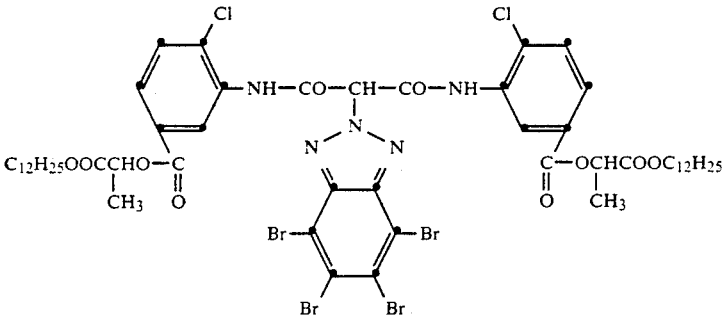
(Coupler 23)
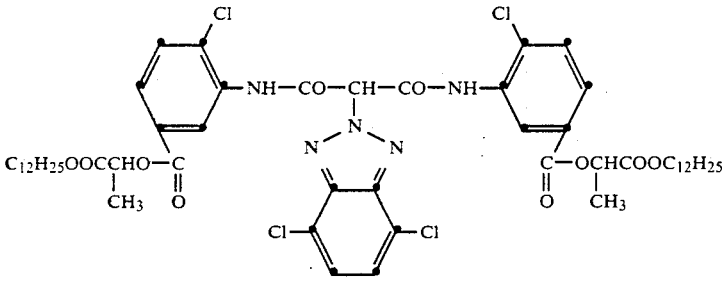
(Coupler 24)
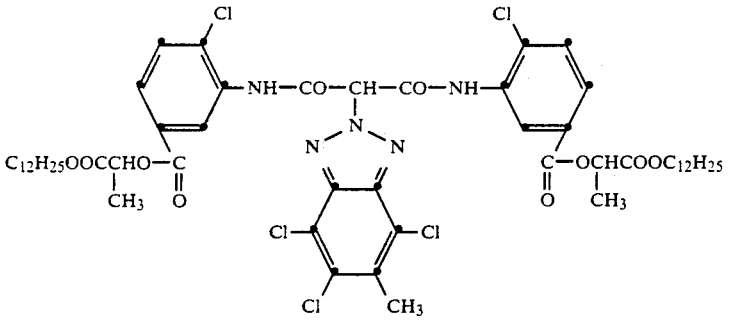
(Coupler 25)
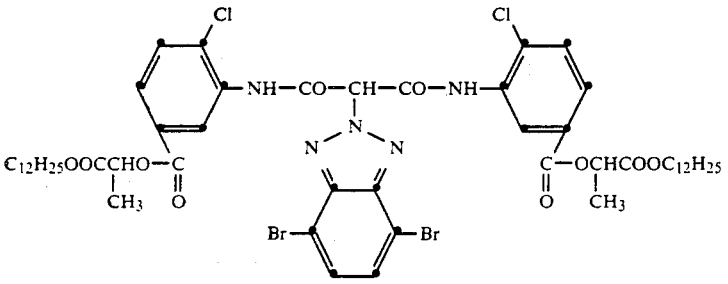
(Coupler 26)

-continued
(Coupler 27)
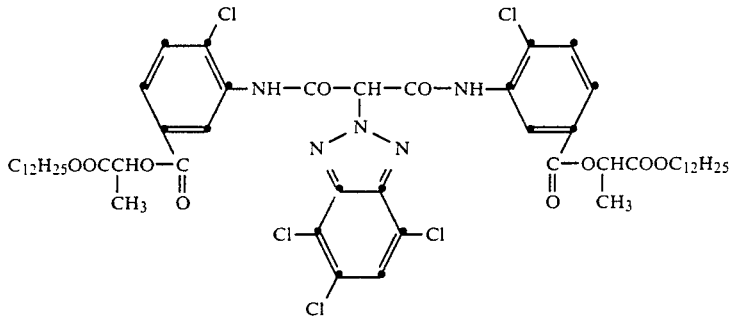
(Coupler 28)
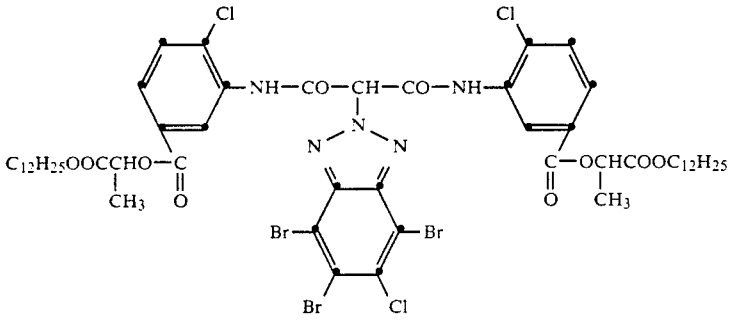
(Coupler 29)
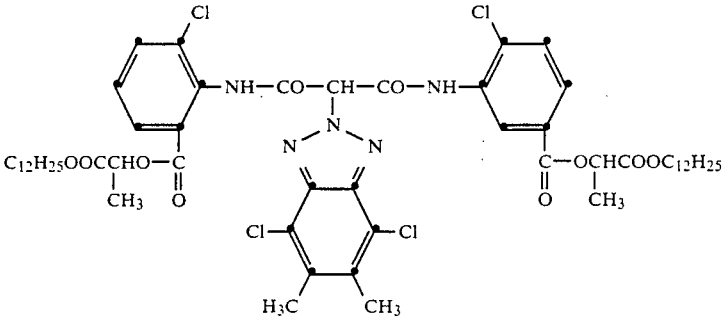
(Coupler 30)
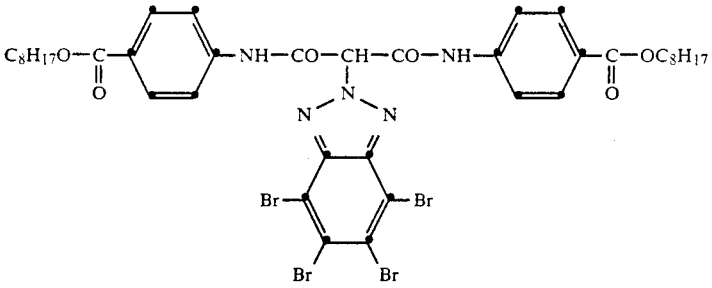
(Coupler 31)
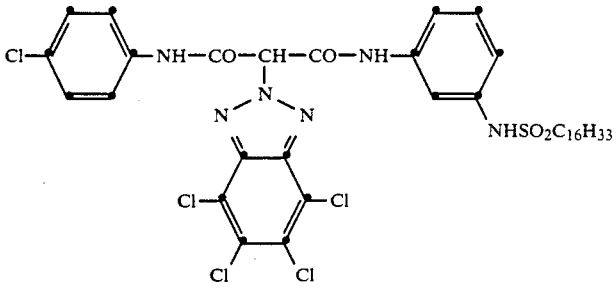

-continued
(Coupler 32)
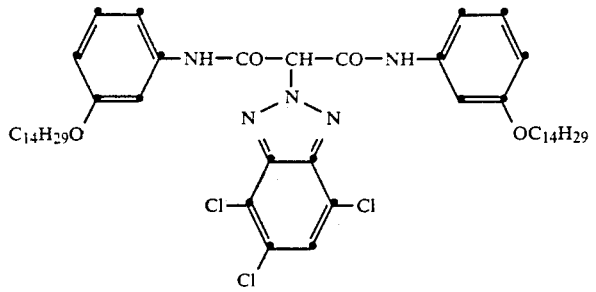
(Coupler 33)
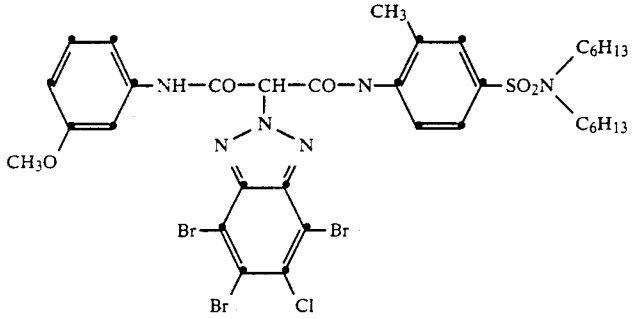
(Coupler 34)
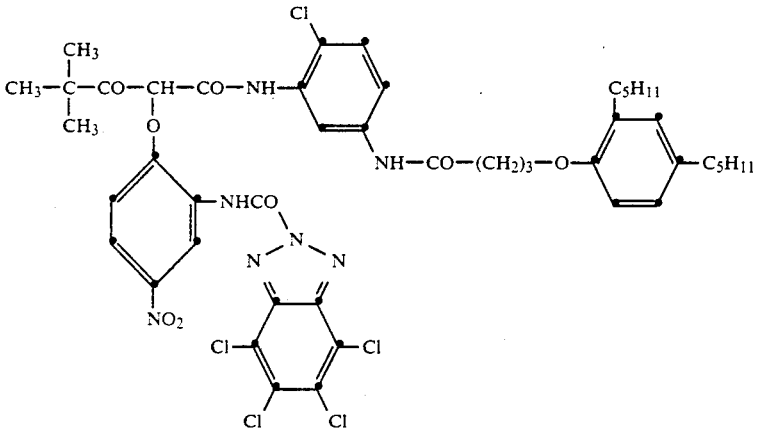
(Coupler 35)
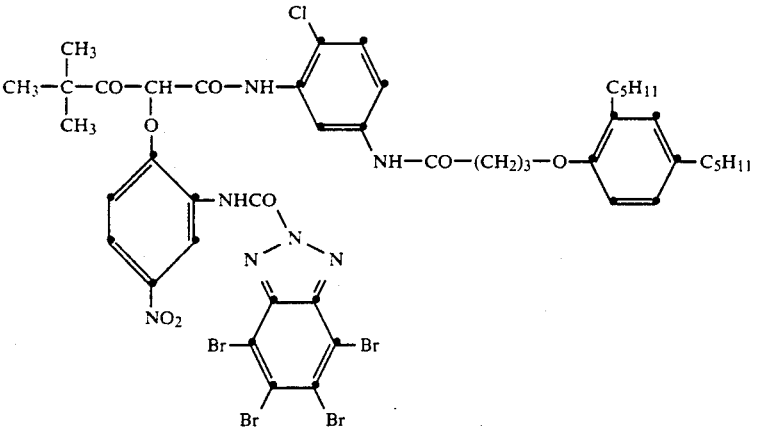

-continued
(Coupler 36)
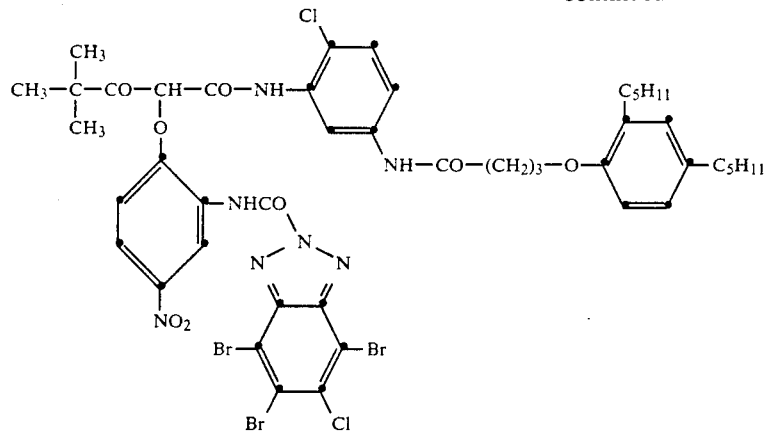
(Coupler 37)
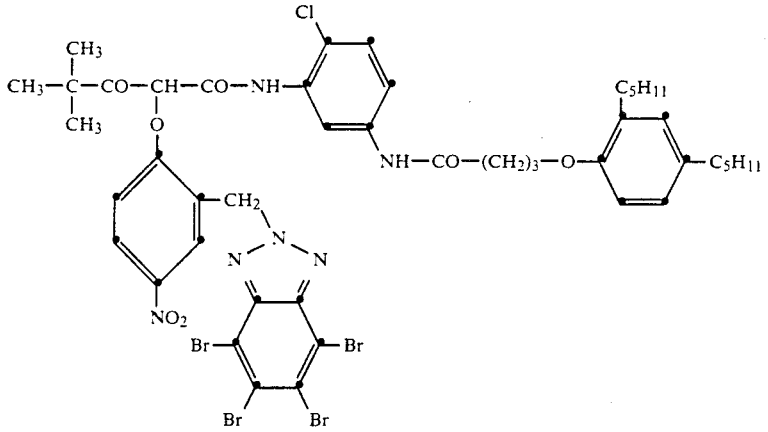
(Coupler 38)
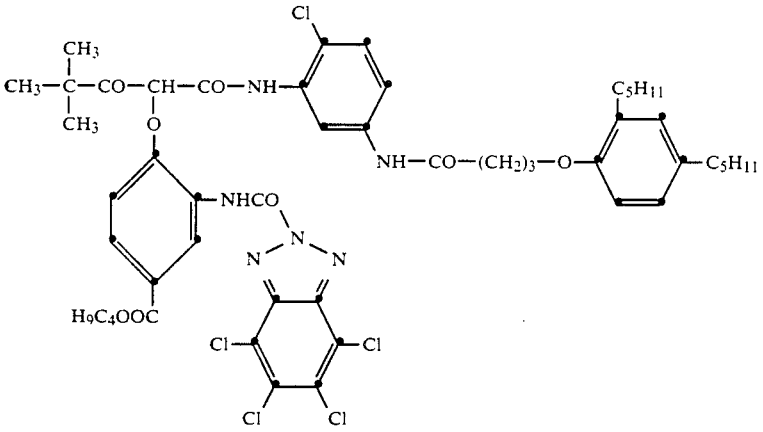
(Coupler 39)
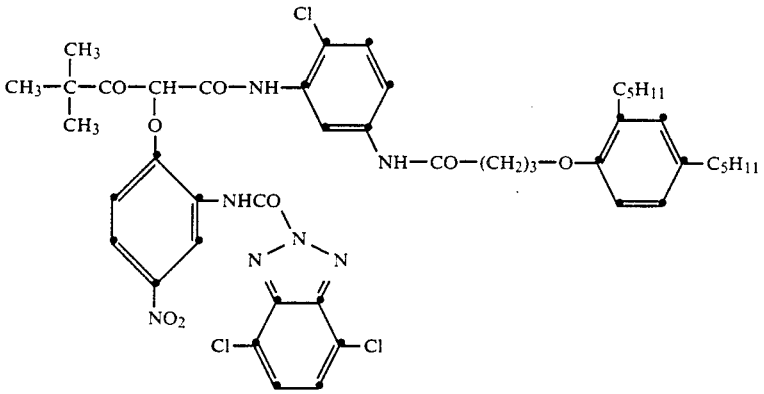

The couplers of the present invention can be synthesized according to conventional ways as those for synthesizing DIR couplers. Typical examples of synthesis of the couplers of the present invention are given below.

SYNTHESIS EXAMPLE 1

Synthesis of coupler (1): N-{2-chloro-5-[4-(2,4-ditert-.amylphenoxy)-butyramido]}-phenyl-2-(4,5,6,7-tetrachlorobenzotriazol-2-yl)-4,4-dimethyl-3-oxo-pentanamide.

To a solution of 6.05 g (0.01 mole) of N-{2-chloro-5-[4-(2,4-ditert.amylphenoxy)-butyramido]}-phenyl-4,4-dimethyl-3-oxo-pentanamide in 80 ml chloroform was addded a solution of 30 ml of 0.3892 M bromine in chloroform cooling to 5° C. After stirring for 3 hours, the organic solution was washed with water, dried over sodium sulphate and concentrated to 30 ml under vacuum. This solution was added to a solution of 2.95 g (0.0115 mole) 4,5,6,7-tetrachlorobenzotriazole (prepared as described in Journal of American Chemical Society, Vol. 77, p. 5105, 1955) and 1.486 g (0.0115 mole) diisopropylethylamine in 40 ml chloroform. The mixture was stirred a night, washed with water, 1 M hydrochloric acid, then water again, dried over sodium sulphate and dried under vacuum. The raw compound was crystallized from heptane to give 5 g (60% yield) of Coupler 1.

SYNTHESIS EXAMPLE 2

Synthesis of coupler (3): N-{2-chloro-5-[4-(2,4-ditert-.amylphenoxy)-butyramido]}-phenyl-2-(4,5,6,7-tetrabromobenzotriazol-2-yl)-4,4-dimethyl-3-oxopentanamide.

This compound was prepared according the procedures described for coupler (1) using 4,5,6,7-tetrabromobenzotriazole (prepared according to the same literature reference for 4,5,6,7-tetrachlorobenzotriazole) to give 7 g of coupler (3).

SYNTHESIS EXAMPLE 3

Synthesis of coupler (22): Bis-{N-<2-chloro-5-(1-dodecyloxycarbonyl)-ethyloxycarbonyl>}-2-(4,5, 6,7-tetrachlorobenzotriazol-2-yl)-malonodiamide.

To a solution of 8.82 g (0.01 mole) bis-{N-<2-chloro-5-(1-dodecyloxycarbonyl)-ethyloxycarbonyl>}-malonodiamide in 80 ml chloroform was added a solution of 30 ml of 0.3892 1 M bromine in chloroform cooling to 5° C. After stirring for 3 hours, the organic solution was washed with water, dried over sodium sulphate and concentrated to 30 ml under vacuum. This solution was added to a solution of 2.95 g (0.0115 mole) 4,5,6,7-tetrachlorobenzotriazole and 1.486 g (0.0115 mole) diisopropylethylamine in 40 ml chloroform. The mixture was stirred a night, washed with water, 1 M hydrochloric acid, then water again, dried over sodium sulphate and dried under vacuum. The raw compound was crystallized from ethanol, then from methanol to give 5 g (45% yield) of Coupler 22.

The structures of the above couplers were confirmed by elemental analysis, IR spectra and $^{1}H$ and $^{13}C$ spectra, especially to confirm the 2-nitrogen bond of the benzotriazole ring. The 2-nitrogen bond was confirmed also by Thermospray-Mass Spectroscopy analysis.

The yellow dye forming DIR couplers of the present invention can be hydrophilic couplers (Fischer type couplers) having a water-solubilizing group, for example a carboxy group, a hydroxy group, a sulfo group, etc., or hydrophobic couplers. As methods for adding the couplers to an hydrophilic colloid solution or to a gelatino-silver halide photographic emulsion or dispersing said couplers thereof, those methods conventionally known in the art can be applied. For example, hydrophobic couplers of the present invention can be dissolved in an high boiling water insoluble solvent and the resulting solution emulsified into an aqueous medium as described for example in U.S. Pat. Nos. 2,304,939, 2,322,027, etc., or said hydrophobic couplers are dissolved in said high boiling water insoluble organic solvent in combination with low boiling organic solvents and the resulting solution emulsified into the aqueous medium as described for example in U.S. Pat. Nos. 2,801,170, 2,801,171, 2,949,360, etc.

The photographic elements of the present invention are preferably multilayer color elements comprising a blue sensitive or sensitized silver halide emulsion layer associated with yellow dye-forming color couplers, a green sensitized silver halide emulsion layer associated with magenta dye-forming color couplers and a red sensitized silver halide emulsion layer associated with cyan dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

The silver halide emulsion used in this invention may be a fine dispersion of silver chloride, silver bromide, silver chloro-bromide, silver iodobromide and silver chloro-iodo-bromide in a hydrophilic binder. As hydrophilic binder, any hydrophilic polymer of those conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethyl-cellulose, etc., a synthetic resin, such as polyvinyl alcohol, polyvinylpyrrolidone, polyacrylamide, etc. Preferred silver halides are silver iodo-bromide or silver iodo-bromo-chloride containing 1 to 20 % mole silver iodide. The silver halide grains may have any crystal form such as cubical, octahedral, tabular or a mixed crystal form. The silver halide can have a uniform grain size or a broad grain size distribution. The size of the silver halide ranges from about 0.1 to about 5 $\mu$. The silver halide emulsion can be prepared using a single-jet method, a double-jet method, or a combination of these methods or can be matured using, for instance, an ammonia method, a neutralization method, an acid method, etc. The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic element con contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVII, December 1978. The light-sensitive silver halides contained in the photographic elements of the present invention after exposure can be processed to form a visible image by associating the silver halide with an aqueous alkaline medium in the presence of a developing agent contained in the medium or in the element. Processing formulations and techniques are described in Research Disclosure 17643, XIX, XX and XXI, December 1978.

The present invention will be now illustrated in greater detail by reference to the following example.

EXAMPLE 1

A control multilayer negative color film (Film A) was made by coating a subbed cellulose triacetate support base with the following layers in the order:

Layer 1. Least sensitive green-sensitive magenta dye forming silver halide emulsion layer comprising a blend of 40% by weight of a low speed silver bromochloroiodide gelatin emulsion (having 87.6% mole bromide, 5.2% mole chloride, 7.2% mole iodide and an average diameter of 0.40 μm) and 60% by weight of a medium speed silver bromoiodide gelatin emulsion (having 97.5% mole bromide, 2.5% mole iodide and an average diameter of 0.30 μm). The low and medium emulsions were both chemically sensitized with sulphur and gold compounds, added with stabilizers, antifogging agents and green spectral sensitizing dyes. The layer was coated at a total silver coverage of 1.5 g/m$^2$, gelatin coverage of 1.6 g/m$^2$, 547 mg/m$^2$ of the 4-equivalent magenta dye forming coupler A, 56 mg/m$^2$ of the magenta dye forming DIR coupler B, 52 mg/m$^2$ of the yellow colored magenta forming coupler C and 104 mg/m$^2$ of the yellow colored magenta forming coupler D.

Layer 2. More sensitive green sensitive magenta dye forming silver halide emulsion layer comprising a fast silver bromoiodide gelatin emulsion (having 89% mole bromide, 11% mole iodide and an average diameter of 0.62 μm) chemically sensitized with sulphur and gold compounds, added with stabilizers and antifogging compounds and blue spectral sensitizing dyes. The layer was coated at silver coverage of 0.55 g/m$^2$, gelatin coverage of 0.7 g/m$^2$, 122 mg g/m$^2$ of the coupler A, 3 mg/m$^2$ of the magenta dye forming DIR coupler B, 6 mg/m$^2$ of the yellow colored magenta coupler C and 12 mg/m$^2$ of the yellow colored magenta forming coupler D.

Layer 3. Interlayer comprising gelatin and a gelatin hardener coated at gelatin coverage of 0.8 g/m$^2$.

Layer 4. Yellow colloidal silver filter layer comprising 0,08 g/m$^2$ of silver and 1.1 g/m$^2$ of gelatin.

Layer 5. Least sensitive blue sensitive yellow dye forming silver halide emulsion layer comprising a blend of 70% by weight of a low speed silver bromoiodide gelatin emulsion (having 96.8% mole bromide, 3.2% mole iodide and an average diameter of 0.53 μm) and 30% by weight of a medium speed silver bromoiodide gelatin emulsion (having 96.8% mole bromide, 3.2% mole iodide and an average diameter of 0.78 μm). The low and medium emulsions were both chemically sensitized with sulphur and gold compounds, added with stabilizers, antifogging agents and blue spectral sensitizing dyes. The layer was coated at a total silver coverage of 0.55 g/m$^2$, gelatin coverage of 2.3 g/m$^2$, 857 mg/m$^2$ of the 2-equivalent yellow dye forming coupler E and 43 mg/m$^2$ of the yellow dye forming DIR coupler F.

Layer 6. More sensitive blue sensitive yellow dye forming silver halide emulsion layer comprising a fast silver bromoiodide gelatin emulsion (having 92% mole bromide, 8% mole iodide and an average diameter of 1.02 μm) chemically sensitized with sulphur and gold compounds, added with stabilizers and antifogging compounds and blue spectral sensitizing dyes. The layer was coated at silver coverage of 0.65 g/m$^2$, gelatin coverage of 1.3 g/m$^2$, 760 mg/m$^2$ of the 2-equivalent yellow dye forming coupler E and 30 mg/m$^2$ of the yellow dye forming DIR coupler F.

Layer 7. Protective gelatin overcoat comprising a gelatin hardener coated at 1,17 g/m$^2$ of gelatin.

A multilayer color negative film (Film B) according to the present invention was made by coating the subbed cellulose triacetate support with the following layers in the indicated order:

Layer 1. Least sensitive green sensitive magenta forming layer (Layer 1 of Film A).

Layer 2. More sensitive green sensitive magenta forming layer (Layer 2 of Film A).

Layer 3. Interlayer (Layer 3 of Film A).

Layer 4. Yellow colloidal silver filter layer (Layer 4 of Film A).

Layer 5. Least sensitive blue sensitive yellow dye forming layer (layer 5 of Film A comprising 65 mg/m$^2$ of the yellow dye forming DIR coupler 22 instead of 43 mg/m$^2$ of the yellow dye forming DIR coupler F).

Layer 6. More sensitive blue sensitive yellow dye forming layer (Layer 6 of Film A comprising 46 mg/m$^2$ of the yellow dye forming DIR coupler 22 instead of 30 mg/m$^2$ of the yellow dye forming DIR coupler F).

Layer 7. Protective gelatin overcoat (Layer 7 of Film A).

A control multilayer color negative film (Film C) was made by coating the subbed cellulose triacetate support with the following layers in the indicated order:

Layer 1. Least sensitive green sensitive magenta forming layer (Layer 1 of Film A).

Layer 2. More sensitive green sensitive magenta forming layer (Layer 2 of Film A).

Layer 3. Interlayer (Layer 3 of Film A).

Layer 4. Yellow colloidal silver filter layer (Layer 4 of Film A).

Layer 5. Least sensitive blue sensitive yellow dye forming layer (layer 5 of Film A comprising 51 mg/m$^2$ of the yellow dye forming DIR coupler G instead of 43 mg/m$^2$ of the yellow dye forming DIR coupler F).

Layer 6. More sensitive blue sensitive yellow dye forming layer (Layer 6 of Film A comprising 37 mg/m$^2$ of the yellow dye forming DIR coupler G instead of 30 mg/m$^2$ of the yellow dye forming DIR coupler F).

Layer 7. Protective gelatin overcoat (Layer 7 of Film A).

A control multilayer color negative film (Film D) was made similar to Film A but having no DIR couplers in the two blue sensitive yellow dye forming couplers.

Coupler A
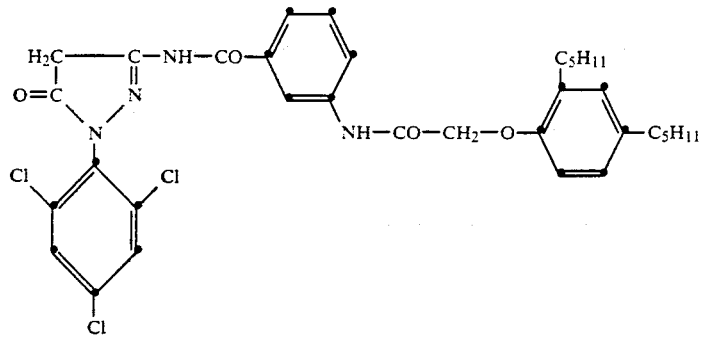
Coupler B
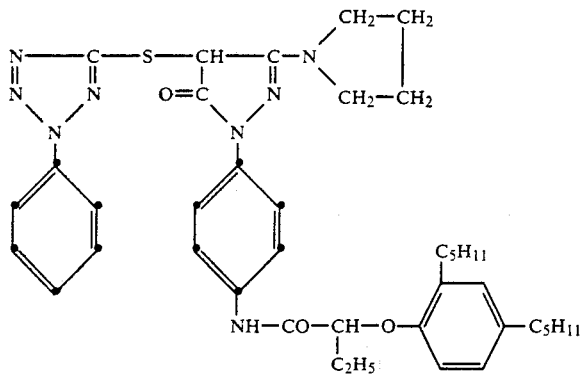
Coupler C
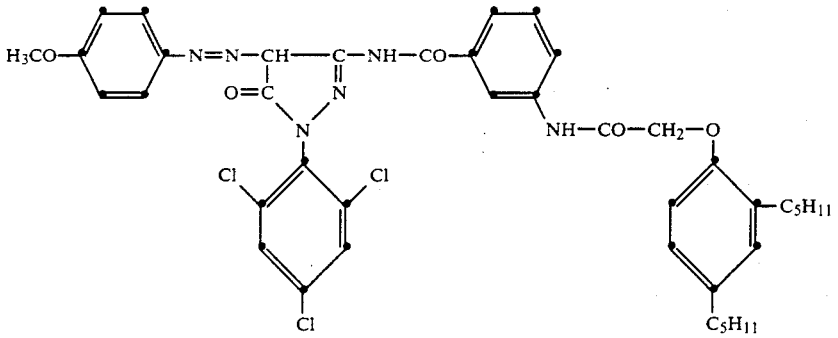
Coupler D
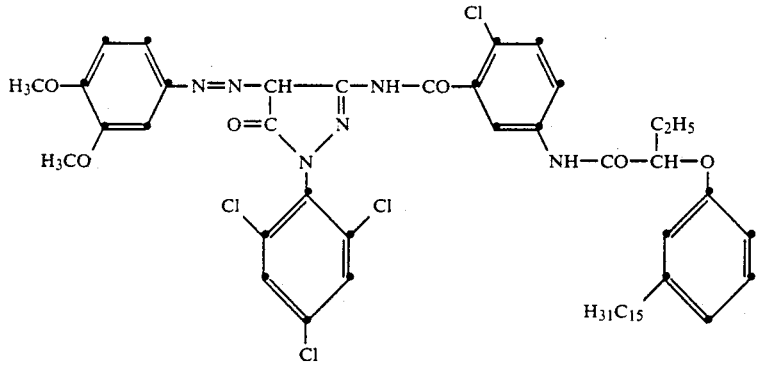
Coupler E
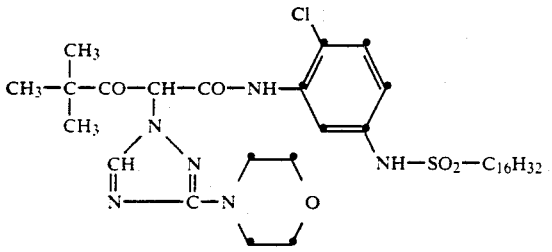

-continued

Coupler F

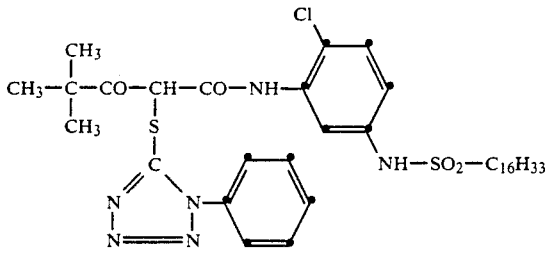

Coupler G

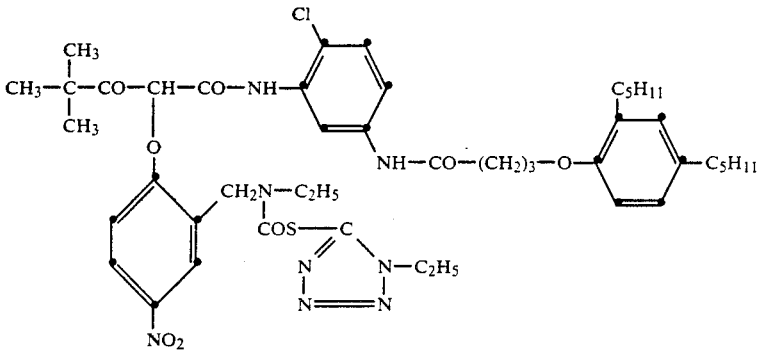

Samples of each film were exposed to a light source having a color temperature of 5,500 Kelvin through a WRATTEN TM W99 filter and an optical step wedge (selective exposure). Other samples of each film were exposed as above but without using any filter (white light exposure). All the exposed samples were developed in a standard type C41 process as described in British Journal of Photography, July 12, 1974, pp. 597–598. Contrasts of the obtained sensitometric curves for selective exposures (gamma$_S$) and white light exposures (gamma$_W$) were measured in the low dye-density or toe region (B1) and in the high dye-density or shoulder region (B2) of each sensitometric curve. Table 1 reports the values of $$R = \frac{\text{gamma}_S - \text{gamma}_W}{\text{gamma}_W} \times 100$$

TABLE 1

| Film | R (B1) | R (B2) |
|---|---|---|
| A | 11 | 12 |
| B | 15 | 9 |
| C | 15 | 15 |
| D | 4 | 4 |

The higher the R numbers, the better are the interimage effects. The film B comprising the DIR coupler (22) of the present invention shows improved interimage effects mainly in low density area of the sensitometric curve which means better vertical effects and color reproduction.

EXAMPLE 2

A control multilayer negative color film (Film E) was made by coating a subbed cellulose triacetate support base with the following layers in the order:

Layer 1. Least sensitive green-sensitive magenta dye forming silver halide emulsion layer comprising a blend of 40% by weight of a low speed silver bromochloroiodide gelatin emulsion (having 87.6% mole bromide, 5.2% mole chloride, 7.2% mole iodide and an average diameter of 0.40 μm) and 60% by weight of a medium speed silver bromoiodide gelatin emulsion (having 97.5% mole bromide, 2.5% mole iodide and an average diameter of 0.30 μm). The low and medium emulsions were both chemically sensitized with sulphur and gold compounds, added with stabilizers, antifogging agents and green spectral sensitizing dyes. The layer was coated at a total silver coverage of 1.3 g/m$^2$, gelatin coverage of 1.4 g/m$^2$, 450 mg/m$^2$ of the 4-equivalent magenta dye forming coupler A, 33 mg/m$^2$ of the magenta dye forming DIR coupler B, 52 mg/m$^2$ of the yellow colored magenta forming coupler C and 104 mg/m$^2$ of the yellow colored magenta forming coupler D.

Layer 2. More sensitive green sensitive magenta dye forming silver halide emulsion layer comprising a fast silver bromoiodide gelatin emulsion (having 89% mole bromide, 11% mole iodide and an average diameter of 0.62 μm) chemically sensitized with sulphur and gold compounds, added with stabilizers and antifogging compounds and blue spectral sensitizing dyes. The layer was coated at silver coverage of 0.80 g/m$^2$, gelatin coverage of 1.0 g/m$^2$, 265 mg g/m$^2$ of the coupler A, 5 mg/m$^2$ of the magenta dye forming DIR coupler B, 9 mg/m$^2$ of the yellow colored magenta coupler C and 18 mg/m$^2$ of the yellow colored magenta forming coupler D.

Layer 3. Interlayer comprising gelatin and a gelatin hardener coated at gelatin coverage of 0.8 g/m$^2$.

Layer 4. Yellow colloidal silver filter layer comprising 0,08 g/m$^2$ of silver and 1.1 g/m$^2$ of gelatin.

Layer 5. Least sensitive blue sensitive yellow dye forming silver halide emulsion layer comprising a blend of 50% by weight of a low speed silver bromochloroiodide gelatin emulsion (having 87.6% mole bromide, 5.2% mole chloride, 7.2% mole iodide and an average diameter of 0.40 μm) and 50% by weight of a medium speed silver bromoiodide gelatin emulsion (having 97.5% mole bromide, 2.5% mole iodide and an average diameter of 0.30 μm). The low and medium emulsions were both chemically sensitized with sulphur and gold compounds, added with stabilizers, antifogging agents and blue spectral sensitizing dyes. The layer was coated at a total silver coverage of 0.75 g/m$^2$, gelatin coverage of 1.80 g/m$^2$, 1,500 E.

Layer 6. More sensitive blue sensitive yellow dye forming silver halide emulsion layer comprising a fast silver bromoiodide gelatin emulsion (having 92% mole bromide, 8% mole iodide and an average diameter of 1.02 μm) chemically sensitized with sulphur and gold compounds, added with stabilizers and antifogging compounds and blue spectral sensitizing dyes. The layer was coated at silver coverage of 0.55 g/m$^2$, gelatin coverage of 1.1 g/m$^2$, 210 mg/m$^2$ of the 2-equivalent yellow dye forming coupler E.

Layer 7. Protective gelatin overcoat comprising a gelatin hardener coated at 1,17 g/m$^2$ of gelatin.

A second control multilayer negative color film (Film F) was made similar to Film E but having in the least sensitive blue sensitive yellow dye forming layer (Layer 5) 114 mg/m$^2$ of the yellow dye forming DIR coupler H.

A multilayer color negative film (Film G) according to the present invention was made by coating the subbed cellulose triacetate support with the following layers in the indicated order:

Layer 1. Least sensitive green sensitive magenta forming layer (Layer 1 of Film E).

Layer 2. More sensitive green sensitive magenta forming layer (Layer 2 of Film E).

Layer 3. Interlayer (Layer 3 of Film E).

Layer 4. Yellow colloidal silver filter layer (Layer 4 of Film E).

Layer 5. Least sensitive blue sensitive yellow dye forming layer (Layer 5 of Film E) comprising 88 mg/m$^2$ of the yellow dye forming DIR coupler 1.

Layer 6. More sensitive blue sensitive yellow dye forming layer (Layer 6 of Film E).

Layer 7. Protective gelatin overcoat (Layer 7 of Film E).

A second multilayer color negative film (Film H) according to the present invention was made by coating the subbed cellulose triacetate support with the following layers in the indicated order:

Layer 1. Least sensitive green sensitive magenta forming layer (Layer 1 of Film E).

Layer 2. More sensitive green sensitive magenta forming layer (Layer 2 of Film E).

Layer 3. Interlayer (Layer 3 of Film E).

Layer 4. Yellow colloidal silver filter layer (Layer 4 of Film E).

Layer 5. Least sensitive blue sensitive yellow dye forming layer (Layer 5 of Film E) comprising 120 mg/m$^2$ of the yellow dye forming DIR coupler 25.

Layer 6. More sensitive blue sensitive yellow dye forming layer (Layer 6 of Film E).

Layer 7. Protective gelatin overcoat (Layer 7 of Film E).

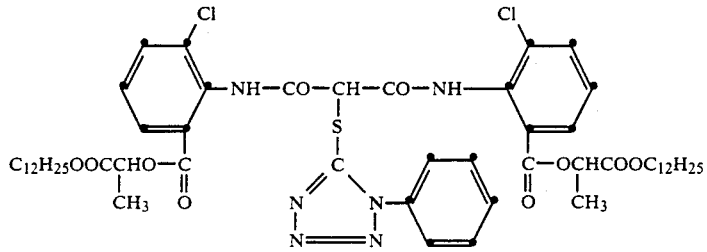

Coupler H

Samples of each film were exposed and developed as described in Example 1. Table 2 reports the values of speed and contrast B1.

TABLE 2

| Film | Speed | Bl |
|---|---|---|
| E | 100 | 9 |
| F | 42 | 24 |
| G | 91 | 16 |
| H | 88 | 24 |

Films G and H comprising the DIR couplers (1) and (25) of the present invention show less speed decrease in comparison with Film F comprising the conventional DIR coupler H and improved interimage effects in comparison with Film E having no DIR compound in the blue sensitive layers.

EXAMPLE 3

A control multilayer negative color film (Film I) was made similar to Film E of Example 2.

A second control multilayer negative color film (Film L) was made by coating the subbed cellulose triacetate support with the following layers in the indicated order:

Layer 1. Least sensitive green sensitive magenta forming layer (Layer 1 of Film E of Example 2).

Layer 2. More sensitive green sensitive magenta forming layer (Layer 2 of Film E of Example 2).

Layer 3. Interlayer (Layer 3 of Film E of Example 2).

Layer 4. Yellow colloidal silver filter layer (Layer 4 of Film E of Example 2).

Layer 5. Least sensitive blue sensitive yellow dye forming layer (Layer 5 of Film E of Example 2) comprising 120 mg/m$^2$ of the yellow dye forming DIR coupler I.

Layer 6. More sensitive blue sensitive yellow dye forming layer (Layer 6 of Film E of Example 2).

Layer 7. Protective gelatin overcoat (Layer 7 of Film E of Example 2).

A multilayer color negative film (Film M) according to the present invention was made similar to Film E of Example 2, but having in the least sensitive blue sensitive yellow dye forming layer (Layer 5) 118 mg/m$^2$ of the yellow dye forming DIR coupler 29.

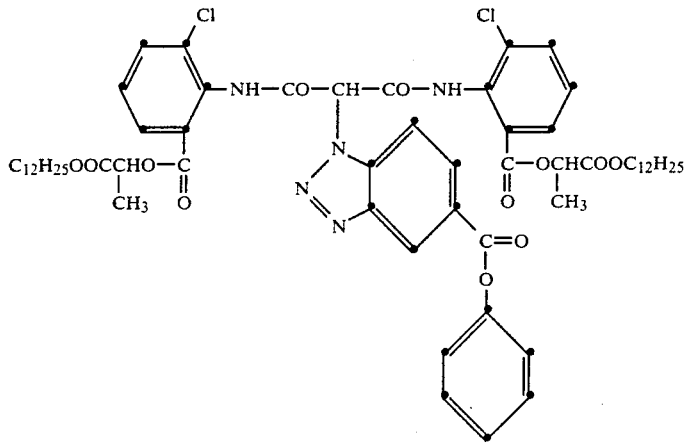

Coupler I (Example 49 of U.S. Pat. No. 4,477,563)

Samples of each film were exposed and developed as described in Example 1. Table 3 reports the values of speed, contrast B1 and R.M.S. granularity (R.M.S. granularity is a measure of diffuse granularity, as described by H. C. Schmitt and J. H. Altman, "Method of Measuring Diffuse RMS Granularity", Applied Optics, vol. 9, pages 871 to 874, April 1970).

TABLE 3

| Film | Speed | Bl | R.M.S. Granularity |
|---|---|---|---|
| I | 100 | 9 | 6.0 |
| L | 88 | 27 | 4.0 |
| M | 88 | 30 | 3.0 |

Film M comprising DIR coupler 29 of the present invention shows better interimage effects and granularity in comparison with Film L comprising the conventional DIR coupler I at a comparable speed decrease.

EXAMPLE 4

A control multilayer color negative film (Film N) was made similar to Film E of Example 2.

A multilayer color negative film (Film O) according to the present invention was made similar to Film E of Example 2 but having in the least sensitive blue sensitive yellow dye forming layer (Layer 5) 141 mg/m$^2$ of the yellow dye forming DIR coupler 23.

A second multilayer color negative film (Film P) according to the present invention was made similar to Film E of Example 2 but having in the least sensitive blue sensitive yellow dye forming layer (Layer 5) 136 mg/m$^2$ of the yellow dye forming DIR coupler 28.

A third multilayer color negative film (Film Q) according to the present invention was made similar to Film E of Example 2 but having in the least sensitive blue sensitive yellow dye forming layer (Layer 5) 118 mg/m$^2$ of the yellow dye forming DIR coupler 27.

A fourth multilayer color negative film (Film R) according to the present invention was made similar to Film E of Example 2 but having in the least sensitive blue sensitive yellow dye forming layer (Layer 5) 115 mg/m$^2$ of the yellow dye forming DIR coupler 24.

Samples of each film were exposed and developed as described in Example 1. Table 4 reports the values of speed, contrast B1 and R.M.S. Granularity.

TABLE 4

| Film | Speed | Bl | R.M.S. Granularity |
|---|---|---|---|
| N | 100 | 9 | 6.0 |
| O | 66 | 17 | 3.8 |
| P | 75 | 17 | 3.8 |
| Q | 91 | 16 | 5.0 |
| R | 93 | 11 | 5.0 |

I claim:

1. A silver halide color photographic lightsensitive material which comprises a support having coated thereon at least one silver halide emulsion layer containing a diketomethylene yellow dye forming coupler having, bonded directly or through a connecting group to the coupling active position, a group which provides a compound having a development inhibiting property when the group is released from the coupler active position upon the color development reaction, wherein said group is a 4,7-dihalogen-2-benzotriazolyl group.

2. The silver halide color photographic light-sensitive material of claim 1, wherein said yellow dye forming coupler is represented by the general formula (I)

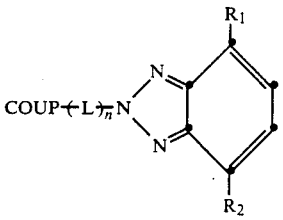

(I)

wherein COUP represents a yellow dye forming coupler residue (with an available bond at the reactive position) which is bonded, directly or through a connecting group, to the 2-nitrogen atom, $R_1$ and $R_2$ may be the same or different and each represents a halogen atom, L represents a connecting group and n represents 0 or 1.

3. The silver halide color photographic light-sensitive material of claim 1, wherein said yellow dye forming coupler is represented by the general formula (II)

(II)

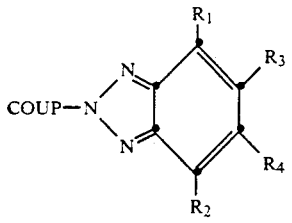

wherein COUP represents a yellow dye forming coupler residue, $R_1$ and $R_2$ each represents a halogen atom and $R_3$ and $R_4$ each represent a hydrogen atom, a halogen atom, an amino group, an alkyl group, an alkoxy group, an hydroxy group, a cyano group, an aryloxy group, an acyloxy group, an acyl group, an alkoxycarbonyl group, an aryloxycarbonyl group, an acylamino group, an alkylsulphonyl group, an arylsulphonyl group, an alkoxysulphonyl group, an aryloxysulphonyl group or an ureido group.

4. The silver halide color photographic light-sensitive material of claim 1, wherein said yellow dye forming coupler is represented by the general formula (III)

(III)

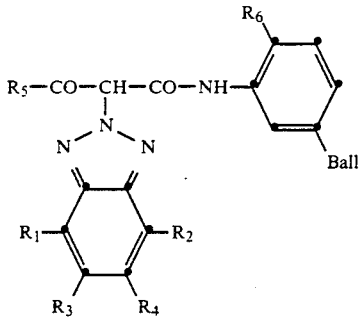

wherein $R_1$ and $R_2$ each represents halogen atom, $R_3$ and $R_4$ each represents a hydrogen atom, a halogen atom or a substituent as defined for formula (II) above, $R_5$ represents an alkyl group or an aryl group, $R_6$ represents an halogen atom, an alkoxy group or an alkyl group and Ball is an hydrophobic ballasting group.

5. The silver halide color photographic light-sensitive material of claim 1, wherein said yellow dye forming coupler is represented by the general formula (IV) or (V)

(IV)

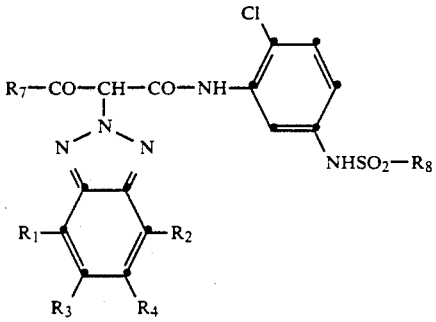

-continued (V)

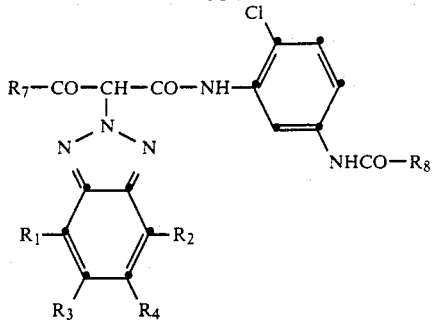

wherein $R_1$ and $R_2$ each represents a halogen atom, $R_3$ and $R_4$ each represents a hydrogen atom, a halogen atom or a substituent as defined for formula (II) above, $R_7$ represents a branched chain alkyl group, $R_8$ represents an alkyl group, a phenoxyalkyl group, an alkoxyphenyl group or an aralkyl group.

6. The silver halide color photographic light-sensitive material of claim 1, wherein said yellow dye forming coupler is represented by the general formula (VI)

(VI)

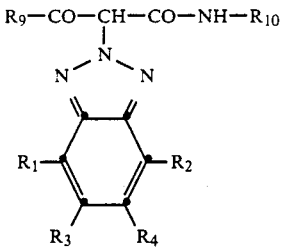

wherein $R_1$ and $R_2$ each represents a halogen atom, $R_3$ and $R_4$ each represents a hydrogen atom, a halogen atom or a substituent as defined for formula (I) above, $R_9$ represents an alkyl group, an aryl group or a $-NR_{11}R_{12}$ group wherein $R_{11}$ represents a hydrogen atom or an alkyl group and $R_{12}$ represents an alkyl group or an aryl group, and $R_{10}$ represents an alkyl group or an aryl group.

7. The silver halide color photographic light-sensitive material of claim 1, wherein said yellow dye forming coupler is capable of releasing the 4,7-dihalogen-2-benzotriazolyl group in a controllable timing.

8. The silver halide color photographic light-sensitive material of claim 7, wherein said yellow dye forming coupler is represented by the general formula (VII)

(VII)

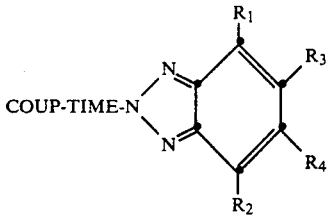

wherein COUP represents a yellow dye forming coupler residue, TIME is a timing group joining the coupler group to the 4,7-dihalogen-2-benzotriazolyl group, $R_1$ and $R_2$ each represents a halogen atom and $R_3$ and $R_4$ each represent a hydrogen atom, a halogen atom or a substituent as defined for formula (II) above.

* * * * *

UNITED STATES PATENT AND TRADEMARK OFFICE

CERTIFICATE OF CORRECTION

PATENT NO. : 5,006,452

DATED : April 9, 1991

INVENTOR(S) : Marco Bucci

It is certified that error appears in the above-identified patent and that said Letters Patent is hereby corrected as shown below:

Column 3, lines 66-67, "benzimidazolylacetamice" should read --benzimidazolylacetimide--.

Column 33, line 4, after "1500" and before "E", add --mg/$m^2$ of the 2-equivalent yellow dye forming coupler--.

Signed and Sealed this

Twenty-sixth Day of October, 1993

*Attest:*

*Attesting Officer*

Bruce Lehman

BRUCE LEHMAN

*Commissioner of Patents and Trademarks*